US012458902B2

(12) United States Patent
Davis

(10) Patent No.: US 12,458,902 B2
(45) Date of Patent: Nov. 4, 2025

(54) FLYING DISC WITH VARIED RIM

(71) Applicant: Michael B. Davis, Cedar Creek, TX (US)

(72) Inventor: Michael B. Davis, Cedar Creek, TX (US)

( * ) Notice: Subject to any disclaimer, the term of this patent is extended or adjusted under 35 U.S.C. 154(b) by 253 days.

(21) Appl. No.: 18/057,276

(22) Filed: Nov. 21, 2022

(65) Prior Publication Data

US 2023/0158418 A1 May 25, 2023

Related U.S. Application Data

(60) Provisional application No. 63/264,404, filed on Nov. 22, 2021.

(51) Int. Cl.
*A63H 33/18* (2006.01)
*A63B 65/10* (2006.01)

(52) U.S. Cl.
CPC ..... *A63H 33/18* (2013.01); *A63B 65/10* (2013.01)

(58) Field of Classification Search
CPC ..... A63H 33/18
See application file for complete search history.

(56) References Cited

U.S. PATENT DOCUMENTS 3,900,986 A * 8/1975 Torres ..... A63H 33/18 446/47
3,959,915 A * 6/1976 Kettlestrings ..... A63H 27/14 473/588
4,023,805 A * 5/1977 Sherrill ..... A63H 33/18 473/588
4,063,382 A * 12/1977 McCallum ..... A63B 67/06 473/589
4,132,030 A * 1/1979 Lehman ..... A63H 33/18 473/588
4,205,484 A * 6/1980 Kovac ..... A63H 33/18 446/46
4,212,131 A * 7/1980 Ross, Jr. ..... A63H 33/18 473/588
4,261,135 A * 4/1981 Lehman ..... A63H 33/18 473/588
4,297,809 A * 11/1981 Branson ..... A63H 33/18 446/46
4,563,160 A * 1/1986 Lee ..... A63H 33/18 446/485
4,820,230 A * 4/1989 Richards ..... A63H 33/18 446/46
4,934,713 A * 6/1990 Hunter ..... A63B 65/08 473/588
5,480,334 A * 1/1996 Wilson ..... A63H 33/18 446/46

(Continued)

*Primary Examiner* — Eugene L Kim
*Assistant Examiner* — Alyssa M Hylinski
(74) *Attorney, Agent, or Firm* — Kowert, Hood, Munyon, Rankin & Goetzel, P.C.

(57) ABSTRACT

Flying discs with different rim shapes in grip sectors and non-grip sectors. This may provide a comfortable throwing grip on a given disc while allowing desired flight characteristics (that may not match the grip shape) due to differing rim wing shapes in non-grip sectors. A set of discs may have the same grip width and shape but different widths and shapes in non-grip sectors. For example, a set of discs with one or more mid-ranges, one or more fairway drivers, and one or more distance drivers all share the same grip feel, in some embodiments.

20 Claims, 13 Drawing Sheets

(56) References Cited

U.S. PATENT DOCUMENTS

| | | | | |
|---|---|---|---|---|
| 5,531,624 | A | 7/1996 | Dunipace | |
| 5,868,395 | A | 2/1999 | Headrick | |
| 6,179,737 | B1 * | 1/2001 | Adler | A63B 65/10 473/588 |
| 6,494,455 | B1 | 12/2002 | Headrick | |
| 6,599,163 | B1 * | 7/2003 | Kotsonis | A63H 33/18 446/46 |
| 6,726,521 | B2 * | 4/2004 | Peterson | A63H 33/18 446/46 |
| 6,739,934 | B1 * | 5/2004 | Adler | A63H 33/18 473/588 |
| 6,860,783 | B1 * | 3/2005 | Kucha | A63H 33/18 446/46 |
| 7,081,032 | B1 * | 7/2006 | Holgate | A63H 33/18 446/46 |
| 7,294,036 | B2 | 11/2007 | Potts | |
| 8,911,274 | B1 * | 12/2014 | Campana | A63H 33/18 446/46 |
| 9,731,216 | B2 | 8/2017 | Richardson et al. | |
| 10,052,564 | B2 * | 8/2018 | Barone | A63H 33/18 |
| 10,399,000 | B1 * | 9/2019 | Fisher | A63H 33/18 |
| 11,235,191 | B2 * | 2/2022 | Krull | A63B 23/1272 |
| 2004/0005837 | A1 * | 1/2004 | Wang | A63H 33/18 446/46 |
| 2004/0132561 | A1 * | 7/2004 | McClung | A63F 9/0243 473/465 |
| 2007/0207883 | A1 * | 9/2007 | Kenner | A63B 65/10 473/588 |
| 2012/0199105 | A1 * | 8/2012 | Smit | A63H 33/18 124/5 |
| 2015/0038046 | A1 * | 2/2015 | Lindberg | A63H 33/18 446/46 |

* cited by examiner

FLYING DISC WITH VARIED RIM

PRIORITY CLAIM

The present application claims priority to U.S. Provisional Application No. 63/264,404, filed Nov. 22, 2021, the disclosure of which is incorporated by reference herein in its entirety.

BACKGROUND

Technical Field

This disclosure relates generally to sports equipment and more particularly to flying discs.

Description of the Related Art

Flying discs are used for recreation and for competitive sports such as ultimate Frisbee and disc golf. For disc golf, multiple classes of discs may be used, such as putters, mid-ranges, fairway drivers, and distance drivers. Discs with different shapes and weight distributions may have substantially different flight characteristics. For example, some disc manufacturers represent flight characteristics using flight numbers for speed, glide, turn, and fade. Various shot shapes may be desirable for different throwing situations, including flex shots, hyzer flips, spike hyzers, flat-to-fade, turnovers, etc., as understood by those familiar with the sport. Certain discs may facilitate certain shot shapes at different disc speeds. Some throwers prefer certain rim depths, shapes, or widths, e.g., due to different hand sizes, grip styles, throwing forms, etc. Typically, a greater width of the disc rim (which is grasped by the thrower) results in a greater disc speed and distance when thrown.

U.S. Pat. No. 6,739,934 describes a flying disc sporting toy having a rim of varying radial width. The '934 patent states that "discs having wide rims fly farthest" but that "if the rim is too wide, the thrower encounters difficulty maintaining a secure grip on the rim up to the desired instant of release." The '934 patent provides "both the long flight benefits of a wide rim and a narrower rim region for a secure grip."

Other discs with interesting shapes include The Wheel (wide flat middle rim) and the Turbo Putt (wavy rim and spiral on underside of flight plate) by Quest AT discs and the Velocity (dimpled flight plate) by Ching, and the Aerobie flying ring.

DETAILED DESCRIPTION

As discussed in detail below, a disc may have one or more grip sectors with substantially different characteristics than typical for a disc with the same flight characteristics. This may allow a comfortable grip while maintaining desired flight characteristics (that may be different than typical for that grip shape). Further, non-grip regions may be shaped differently than traditional rims, e.g., with more aero-dynamic shapes that do not have rim walls for gripping but provide desirable flight characteristics.

Further, a disclosed set of discs may have grip sectors with the same feel (e.g., rim width, shape, etc.) but substantially different non-grip sectors for different discs in the set. As one example, a mid-range, fairway driver, and distance driver may all have the same grip sector width and shape, but the non-grip sectors may provide the different disc speeds. This may provide throwers with a consistent grip shape and release while still maintaining the flight shape and speed variation of a traditional bag that includes various disc classes.

As one non-limiting example, a mid-range, fairway driver, and distance driver may have the same grip region width but other sectors may have a wider rim for the distance driver and a narrower rim for the mid-range, relative to the grip region. This may allow also a user to purchase such a set of discs from a manufacturer and use the same grip to throw discs with substantially different flight characteristics. This may improve athlete consistency and performance and may improve brand loyalty for a disc producer or a set of coordinating producers that may label certain discs as belonging to certain discs sets with similar grip characteristics. Further, different sets may be produced with different grip region widths, e.g., for users with different hand sizes.

Disclosed discs may have two or more grip sectors to increase rotational symmetry and provide fairly even weight distribution. In some embodiments, a flying disc includes one or more sectors (which may be circular sectors) in which the radial width of the disc rim, cross-sectional shape of the disc rim, material of the disc rim, height of the disc rim, etc.

is different than other sectors of the disc. Sectors of the rim intended to be used by throwers to grip the disc may be referred to herein as grip regions, grip zones, grip sectors, grip portions, etc.

In some embodiments, discs have substantially the same cross-sectional weight in any direction, e.g., by using different materials in portions of the disc or rim with different rim widths or using different shapes for different portions of the bottom of the rim. In some embodiments, one or more techniques are used to reduce weight differences in different cross-sections of a disc, increase rotational symmetry, or both.

Figure 1:
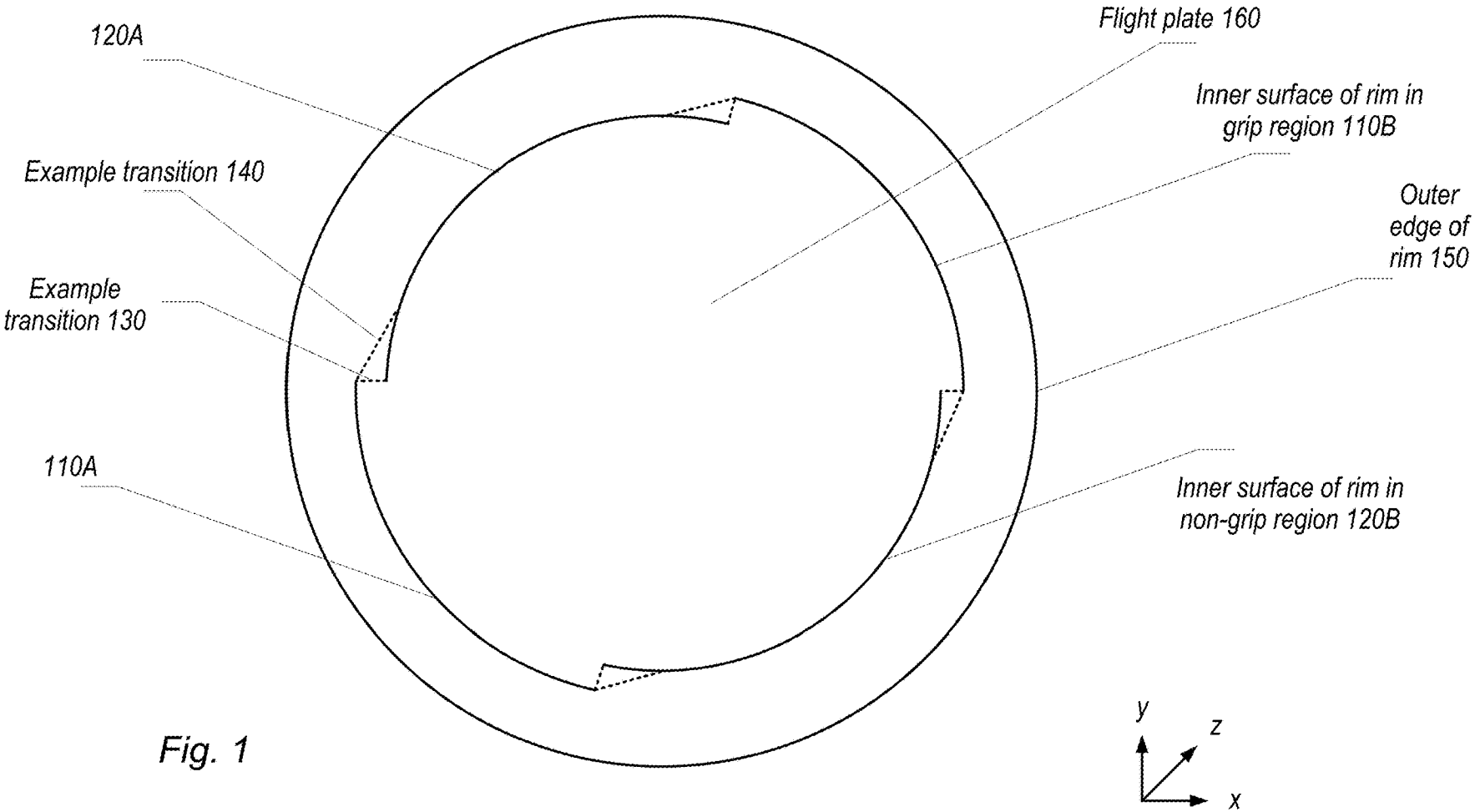
FIG. 1 is a diagram illustrating an underside view of an example disc with different rim widths in different sectors, according to some embodiments.

Overview of Grip Sectors with Different Rim Widths or Shapes than Non-Grip Sectors FIG. 1 is a diagram illustrating an underside view of a disc, according to some embodiments. In the illustrated embodiment, the disc includes a flight plate 160 and a rim with an outer edge 150 and inner surfaces. The top of the flight plate may be parallel with the xy-plane shown in FIG. 1. Flight plates may be substantially flat or may be dome-shaped (or even puddle-shaped) and the curvature of the flight plate may be affected by mold shape, temperature during cooling, type of material used, current temperature, etc. The inner surface of the rim extends down from the flight plate to define a cavity under the flight plate.

Note that the inner surface of the rim may include an inner rim wall for gripping but may have other shapes in non-grip sectors, to increase or decrease aerodynamics, increase or decrease speed, increase or decrease stability, etc. (relative to traditional discs with rims shaped like the grip sectors). Athletes may use their fingers to grip the inner wall (e.g., in a power grip with the thumb on the flight plate and four fingers in contact with the inner wall) when throwing. Other grips such as fan grips may also have parts of the fingers in contact with the bottom of the rim or bottom of the flight plate.

In the illustrated embodiment, the rim has multiple radial widths, defined by inner surfaces at different distances from the center of the flight plate. In particular, grip regions 110A and 110B, in this example, have a narrower rim width than regions 120A and 120B.

As shown, various different shapes of transitions from grip regions to other regions are contemplated. In the illustrated example, transition 130 is substantially parallel to a radius of the disc while transition 140 circle is a more gradual transition that may provide reduced drag relative to transition 130. Other contemplated transition shapes include s-shaped transitions and continuously variable transitions, for example. Further, the transition region on one side of a grip region may have a different shape than the transition region on the other side, which may result in different flights depending on the direction of spin when thrown.

In some embodiments, the inner wall of the grip region may have the same depth as the inner surface of other regions. In other embodiments, the inner wall may have different depths and the transition regions may transition between depths as well as radial widths. Note that the grip region may not have a uniform width across the entire region to be gripped, but its average rim width may be substantially different than the average rim width of other regions. For example, the grip region rim width may be between a first value and a second value that is greater than the first value and the non-grip region rim width may be (A) between the second value and a third value that is greater than the second value or (B) between the first value and a fourth value that is smaller than the first value.

Figure 2:
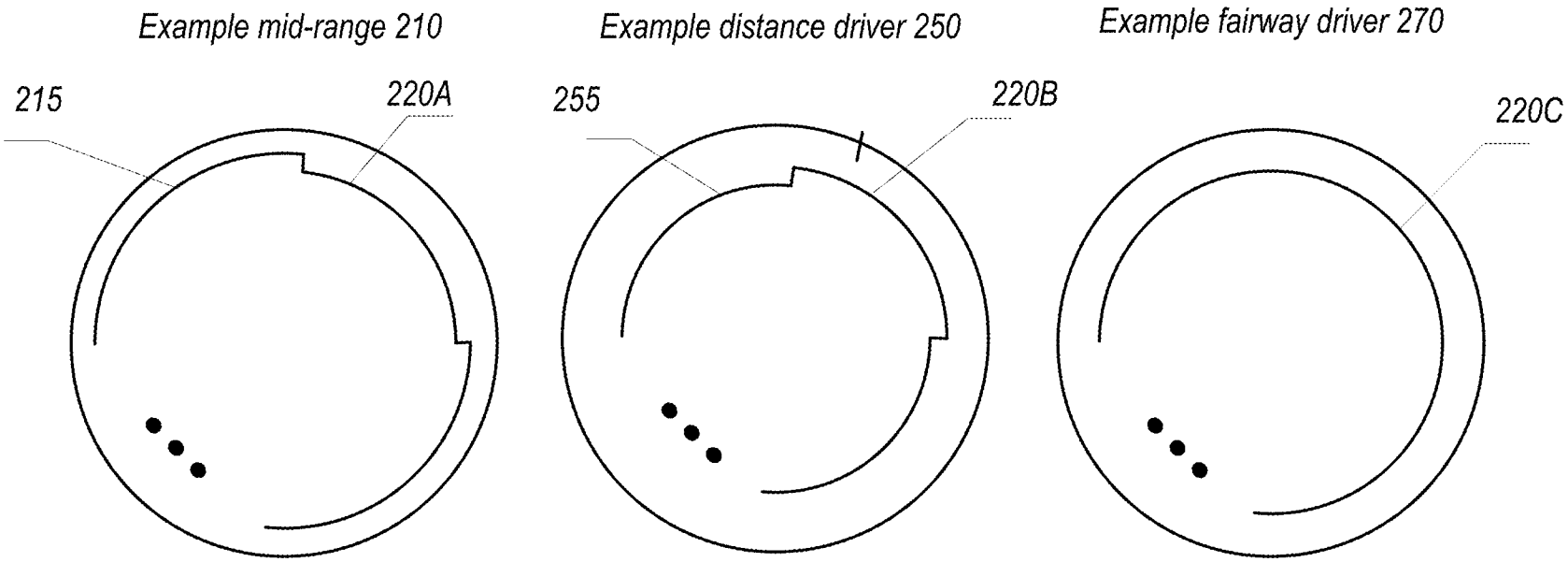
FIG. 2 is a diagram illustrating an example set of discs with the same grip region rim width but different rim widths in other regions, according to some embodiments.

FIG. 2 is a diagram illustrating an example set of discs with the same grip region rim width but different rim widths in other regions, according to some embodiments. The ellipses in the discs of FIG. 2 indicate that the number of grip regions on each disc may vary; one region is shown for purposes of illustration in FIG. 2 but other discs may have 2, 3, 4, or 5 grip regions. In the illustrated example, disc 210 is a mid-range driver in which the grip region 220A is wider than other portions of the rim (e.g., region 215). In this example, distance driver 250 has a grip region 220B that is narrower than other portions of the rim (e.g., region 255). In this example, the fairway driver 270 has the same nominal rim width 220C for the entire disc. In this example, the rim grip widths 220A, 220B, and 220C are nominally equal. In other embodiments, a fairway driver may have a grip region that is narrower or wider than other parts of the rim while the grip region may be the same width as other discs in a set of discs.

The nominal equal grip widths may allow a user to comfortably use all three illustrated discs with a similar throwing form and release, even though the discs may have substantially different properties. For example, the greater rim width of the distance driver 250 may allow it to fly further when imparted with a similar forward velocity and spin rate as a throw of mid-range 210. Further, the different discs may fade or turn differently based on rim width or other factors such as rim shape, parting line height, material, etc. Note that the actual widths may vary slightly from the nominal widths, e.g., due to manufacturing tolerances, non-uniform size changes during disc cooling, etc.

Speaking generally, the average rim width for distance drivers may be around 2.1 centimeters, around 1.7 cm for fairway drivers, around 1.3 cm for mid-range discs, and around 1 cm for putt and approach discs. In some embodiments, the width of the non-grip region of a mid-range is between 1.1 and 1.5 cm. In some embodiments, the width of the non-grip region of a fairway driver is between 1.5 and 1.9 cm. In some embodiments, the width of the non-grip region of a distance driver is between 1.9 and 2.5 cm. In some embodiments, the nominal width of the grip region for a set of discs is between 1.1 and 2.1 centimeters. In some embodiments, the nominal grip region width for a set of discs is between 1.5 and 2 centimeters, which may be a preferred width for comfort for many players. Therefore, example grip region widths include, without limitation: 1.1, 1.2, 1.3, 1.4, 1.5, 1.55, 1.6, 1.65, 1.675, 1.7, 1.725, 1.75, 1.8, 1.9, 2, 2.1, etc. (all in cm).

While three discs are shown for purposes of illustration, a set of discs with the same grip width may include any appropriate number of discs with different rim widths in non-grip regions. For example, a set may include multiple mid-ranges, putters, fairway drivers, or any combination thereof with wider grip regions than non-grip regions. Similarly, a set may include multiple fairway drivers, distance drivers, etc. with narrower grip regions than non-grip regions. Further, the disclosed types of discs are included for purposes of illustration and are not intended to limit the scope of the present disclosure. In other embodiments, various sets of discs with different non-grip rim widths but the same nominal grip rim width are contemplated.

Detailed Examples of Varied-Wing Discs

Figure 3:
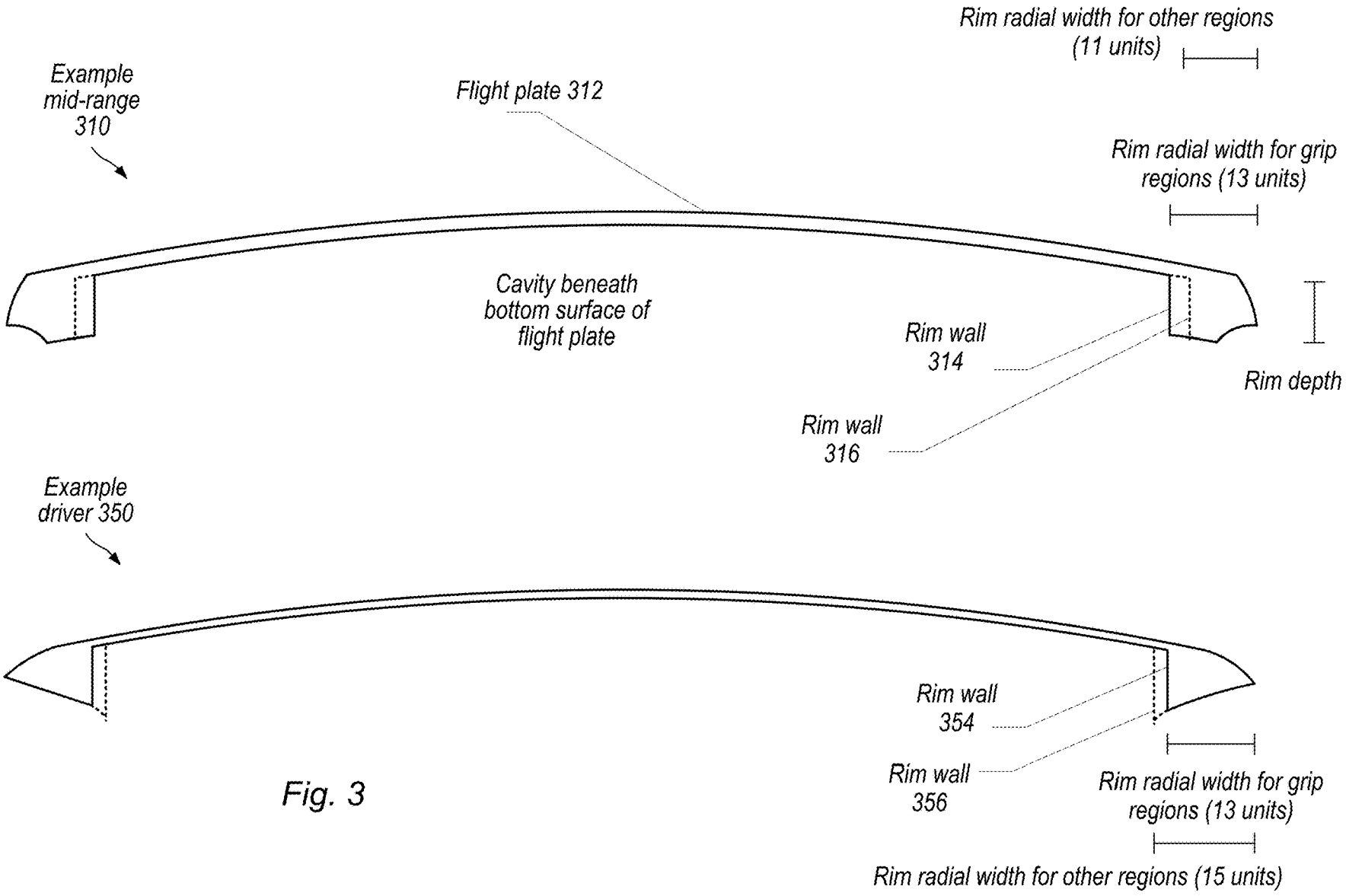
FIG. 3 is a more detailed side-view diagram illustrating two discs with the same grip region width but differing in other characteristics, according to some embodiments.

FIG. 3 is a more detailed side-view diagram illustrating two discs with the same grip region width but differing in other characteristics, according to some embodiments. In the illustrated example, the mid-range 310 and driver 350 have the same overall diameter and the same radial grip width (13 units in the illustrated example, between rim wall 314 and the outer edge of the rim for the mid-range and between rim wall 356 and the outer edge of the rim for the driver). The mid-range has a narrow radial width (between rim wall 316 and the outer edge of the rim) for non-grip regions (11 units in the illustrated example) and the driver has a wider radial width (between rim wall 356 and the outer edge of the rim) for non-grip regions (15 units in the illustrated example). The mid-range and driver also have different rim profiles. The grip region rim walls are shown using solid lines while the non-grip region rim walls are shown using dashed lines (e.g., to denote the rim width if the disc were to be rotated to show the side profile of a non-grip region).

As shown, the rim walls and bottom of the flight plate 312 define a cavity beneath the bottom surface of the flight plate for the mid-rage. A similar cavity is defined for the driver.

While all the illustrated sectors of FIG. 3 have inner rim walls that are substantially perpendicular to the flight plate, some non-grip sectors may have inner surfaces that curve or angle away from the flight plate, an example of which is discussed below.

Figure 4A:
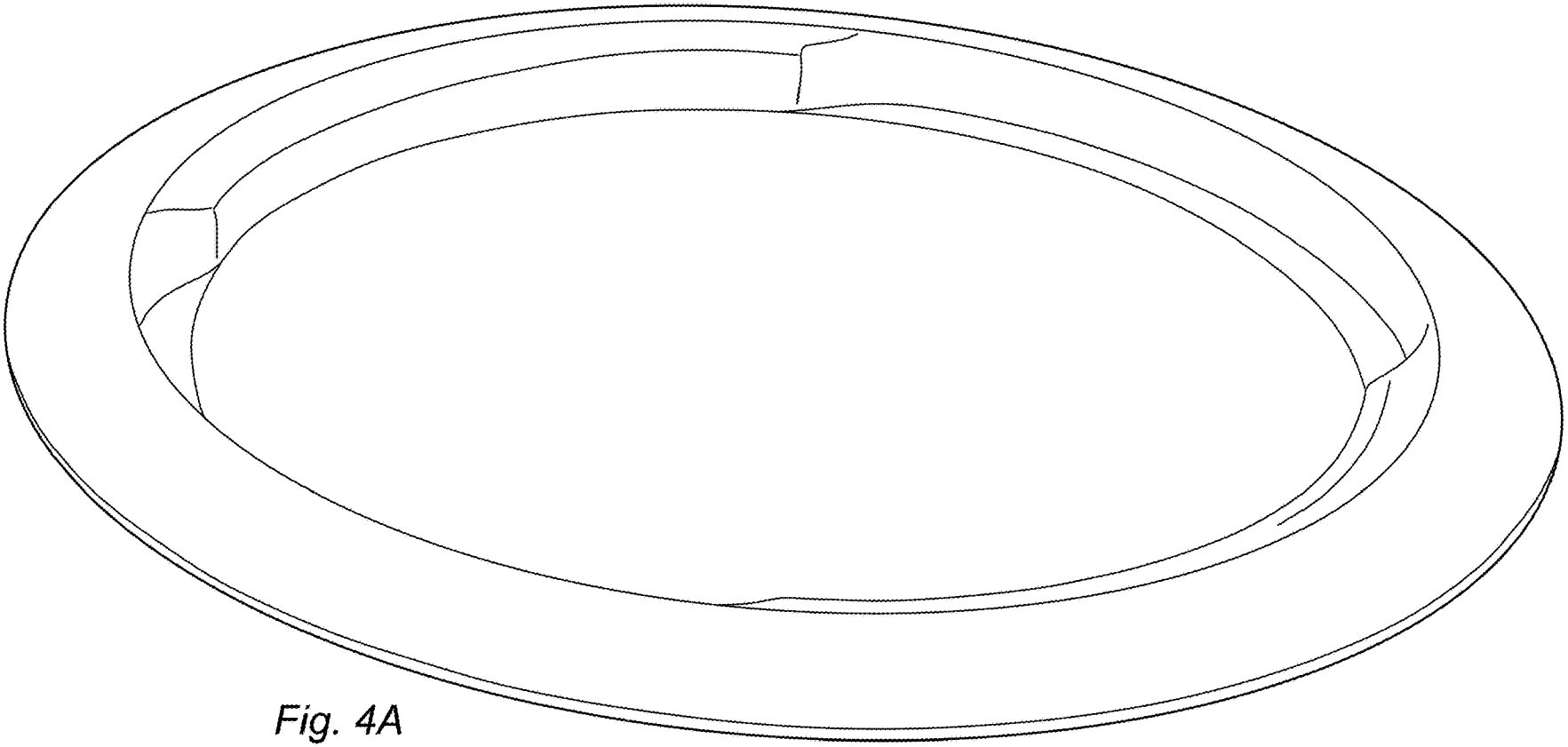
FIG. 4A is a diagram illustrating an example disc with narrower grip sectors and wider, rounded non-grip sectors, according to some embodiments.

FIG. 4A is a diagram illustrating an example disc with narrower grip sectors and wider, rounded non-grip sectors, according to some embodiments. This may allow the non-grip sectors to be more aerodynamic than traditional distance driver rims and provide additional velocity and lift. It may also allow the same grip as a traditional driver with the same with as the grip sectors or a mid-range with even narrower non-grip sectors.

Figure 4B:
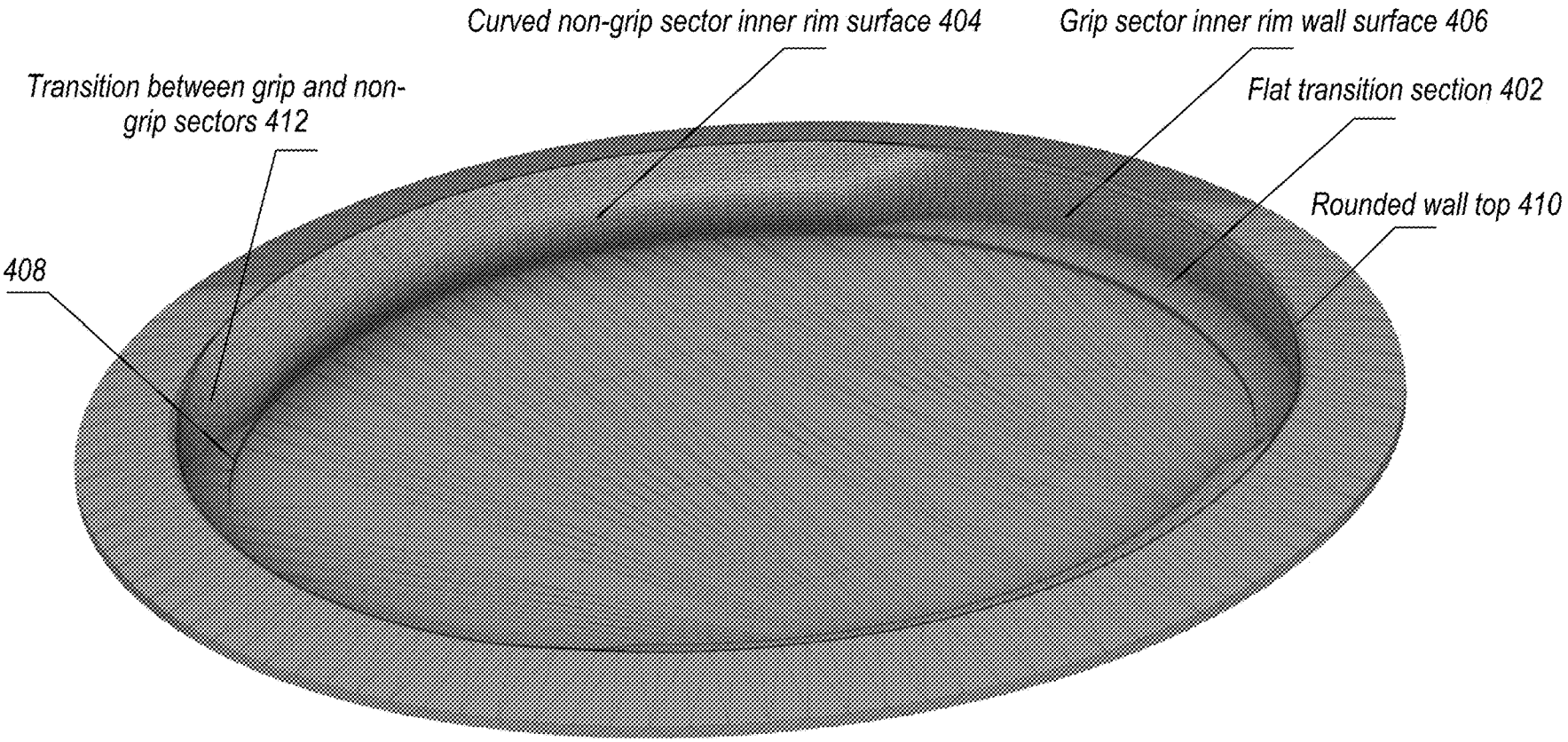
FIG. 4B is a diagram illustrating a mesh view of the example disc of FIG. 4A in more detail, according to some embodiments.

FIG. 4B is a mesh diagram illustrating the example disc of FIG. 4A in more detail, according to some embodiments. As shown, the disc includes a curved non-grip sector inner rim surface 404, a grip sector inner rim wall surface 406 (which is connected to a rounded wall top that transitions to the rim wing and a flat transition section 402 between the wall and the flight plate).

The edge 408 of the flat transition section 402, in the illustrated example, in conjunction with the non-grip sector inner rim surface, forms a circular inner flight plate and consistent rim width while allowing different grip and non-grip wing widths. Note that FIG. 12, discussed in detail below, shows a side profile view of a disc with a flat transition section of a rim.

The inner rim wall surface 406 of a grip sector may be gripped by the thrower while the non-grip sector may have other desired flight characteristics without needing an inner wall for gripping. The flat transition section may be relatively short (e.g., 0.5 to 2 mm thicker than the flight plate, in some embodiments).

The illustrated disc may be more aerodynamic and have a greater speed rating than a disc in which the whole rim was shaped like the grip section. Further, the illustrated disc may be included in a set of discs with the same grip sector shape (and thus similar feel in the hand), but different non-grip sector shapes. For example, other discs in the set may have different shapes of curving or angling away from the flight plate in the non-grip sectors. As another example, other discs in the set may have different non-grip sector rim widths. As another example, different discs may have different thickness in the flat transition section. Therefore, a set of discs with the same grip sector may include discs with dramatically different flight characteristics. The set of discs may also include a more traditional disc, e.g., in which the entire rim is shaped like the grip sector of the illustrated disc.

In embodiments in which another disc in the set has a different non-grip sector rim width, the wall of the grip sector, wing of the grip sector, or both may remain the same on the other disc, but the flat transition section of the other disc may be wider or narrower flat transition section to maintain a circular flight plate in conjunction with the non-grip sector.

In some embodiments, the non-grip sectors include inner rim non-grip surface that angles or curves away from the flight plate. This may occur immediately or within some distance from the flight plate. For example, the G1R1, discussed below with reference to 6B, angles away immediately while in other embodiments the surface may angle or curve away within 1 mm, 1.5 mm, 2 mm, 3 mm, 4 mm, 5 mm, or any appropriate distance as measured in a direction perpendicular to the flight plate. In contrast, the inner rim grip wall may be substantially perpendicular to the flight plate (or a plane corresponding to the perimeter of the flight plate if the flight plate is domed) for at least 7 mm, and typically about 10 to 12 cm to provide room for fingers to grip the rim.

Figure 5C:
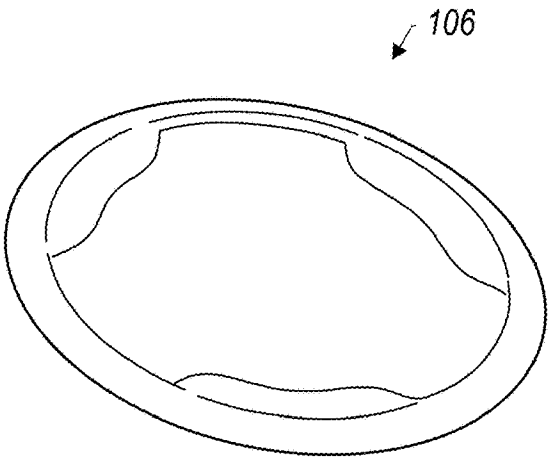
FIGS. 5A-5C are diagram illustrating an example set of discs with the same grip shape and different shapes and speeds of non-grip sectors, according to some embodiments.
Figure 5B:
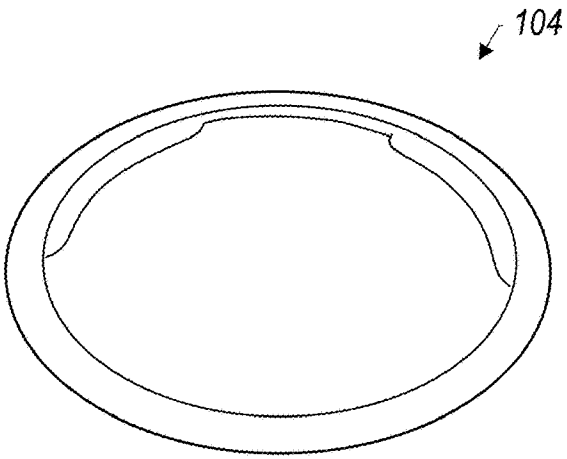
Figure 5A:
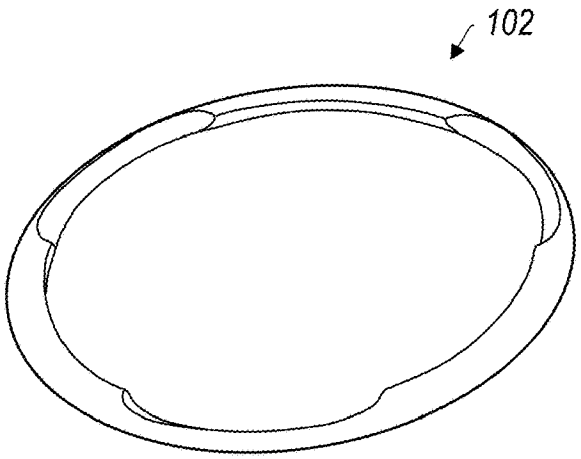

FIGS. 5A-5C are diagrams illustrating an example set of discs, each of which includes three grip sectors and three non-grip sectors. In this example, the grip sectors are all the same shape and width while the non-grip sectors have varying widths and shapes. In particular, FIG. 5A shows a mid-range with narrower non-grip sectors, FIG. 6B shows a fairway driver with wider non-grip sectors, and FIG. 7B shows a distance driver with the widest, highest-speed non-grip sectors. The illustrated set of discs may provide the same feel in the hand with different flights for different discs.

Figure 6C:
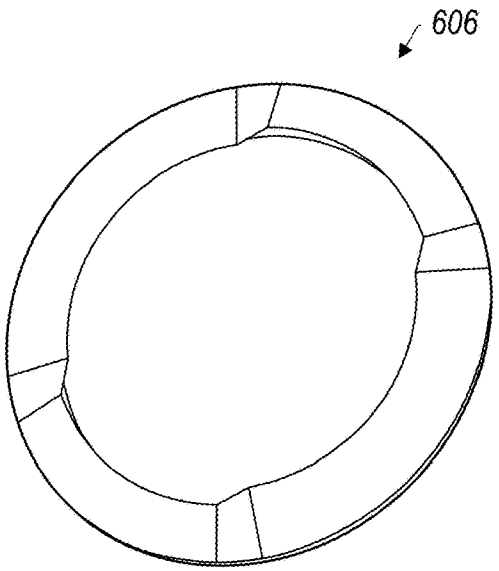
FIG. 6C is a diagram illustrating an example disc with wider non-grip sectors that have an inner diameter smaller than the diameter of its circular flight plate and grip sectors, according to some embodiments.
Figure 6B:
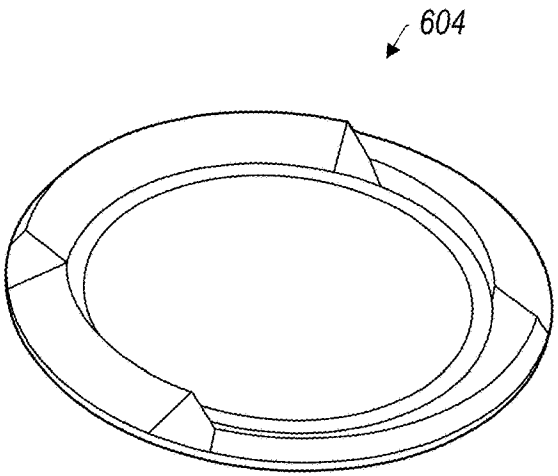
FIG. 6B is a diagram illustrating an example sector G1R1 approach disc with a wider grip and narrower non-grip regions that provide less lift, according to some embodiments.
Figure 6A:
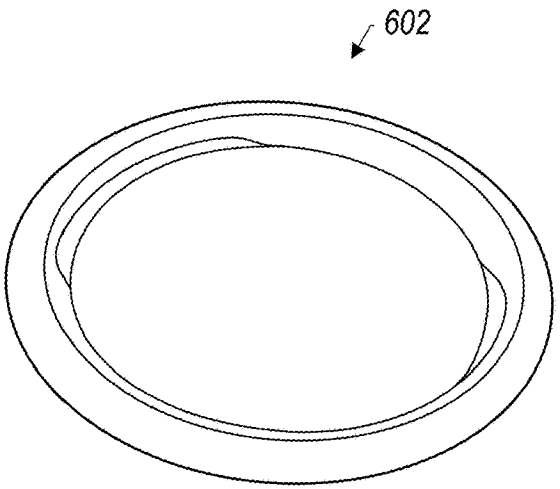
FIG. 6A is a diagram illustrating a rounded driver with a fairway grip and aerodynamic, wider non-grip sectors.

FIG. 6A is a diagram illustrating an example driver similar to FIG. 4A, but with more rounded transitions between grip and non-grip sectors.

FIG. 6B is a diagram illustrating an example Sector G1R1 approach disc. This disc has two distance-driver-like grip sectors and two less aerodynamic non-grip sectors and flies like an overstable 3-4 speed approach disc. The sector G1R1 is an example disc varied-rim disc that has been approved by the PDGA (subsequent to the filing of the 63/264,404 provisional application). The G1R1 is an example disc where the tallest part of the grip sectors is located at a different radial distance from a center of the flight plate than a tallest part of the non-grip sectors.

FIG. 6C is a diagram illustrating an example distance driver with narrow grip sectors than non-grip sectors. In this example, the diameter of the non-grip sectors is greater than the flight plate and the flight plate is circular, such that the angle between the non-grip rim wall and the flight plate is less than 45 degrees. In some embodiments, this disc may be manufactured using injection molding by rotating the disc 90 degrees to remove it from the mold.

In some embodiments, different ends of a grip sector or non-grip sector are shaped differently. For example, the transition region on one side may be shaped differently than the transition region on the other side. This may have the result that the discs flies differently depending on the direction of spin (e.g., differently for a right-hand backhand than a right-hand forehand throw). For example, referring to discs such as FIG. 6C, two of the transition regions may be shaped to increase lift when the disc is spinning such that they are the leading edge of a sector while the other two transition regions may be shaped to reduce drag (e.g., in a teardrop shape with the larger end of the teardrop toward the leading edge). Various other differences in transition region shape are contemplated, e.g., to increase/reduce speed, increase/reduce glide, change flight characteristics depending on the direction of spin, etc.

Figure 7:
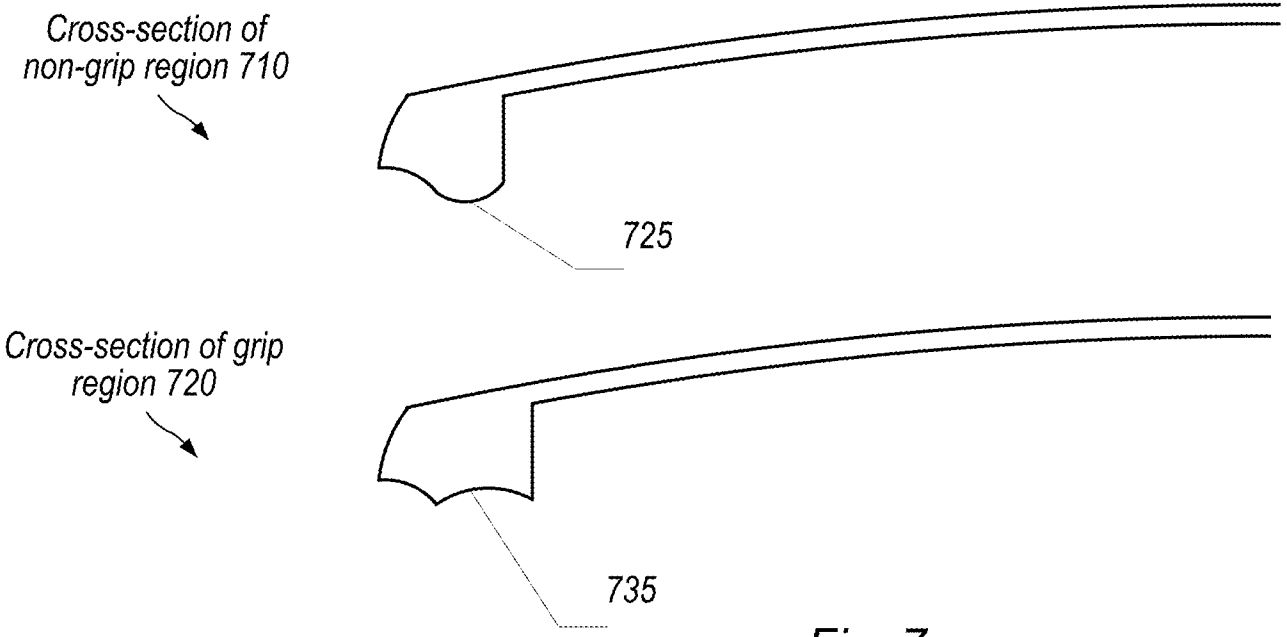
FIG. 7 is a diagram illustrating another example disc with different wing shapes in grip and non-grip regions, according to some embodiments.

FIG. 7 is a diagram illustrating an example disc with different wing shapes in grip and non-grip regions, according to some embodiments. In the illustrated example, the non-grip region 710 has a smaller width than the grip region 720. Assuming traditional molding techniques, this would result in a greater weight in the rim of the disc for the grip region. In the illustrated embodiment, however, the different wing shapes may reduce or eliminate this difference in weight. In particular, in the illustrated example, portion 725 of the non-grip region is convex while portion 735 of the grip region is concave. In this example, the convex shape of the non-grip region adds additional disc material relative to the concave shape (at a certain radial distance from the center of the disc), resulting in a more even weight distribution between the two sectors. In some embodiments with different wing shapes, the disc retains the property that, when laid on a flat surface, there is continuous contact by the entire rim of the disc with the surface. Thus, the different portions may have the same effective height even though they are shaped differently. In some embodiments, discs with different wing shapes may have different average rim depths in different sectors.

As used herein, the term "shape" in the context of a portion of the rim refers to the shape of a cross-section of the rim, e.g., as shown in FIG. 7. Two rim sectors with different shapes may be partially the same (e.g., with the same height, same leading edge shape, etc.) but partially different (e.g., convex/concave in a portion of the cross-section, with/without a wall for gripping, etc.).

In some embodiments, across a set of discs, the grip region has the same wing shape while other rim regions may have different shapes on different discs. This may allow the grip regions for the set of discs to feel similar, in addition to having the same grip width while also allowing the discs to have substantially different flight characteristics.

For drivers, for example, discs with the same grip sector shape may have different non-grip wing shapes, e.g., with different parting line heights, convex, flat, or concave underwing portions, etc.

Example Discs with Different Materials

Figure 8:
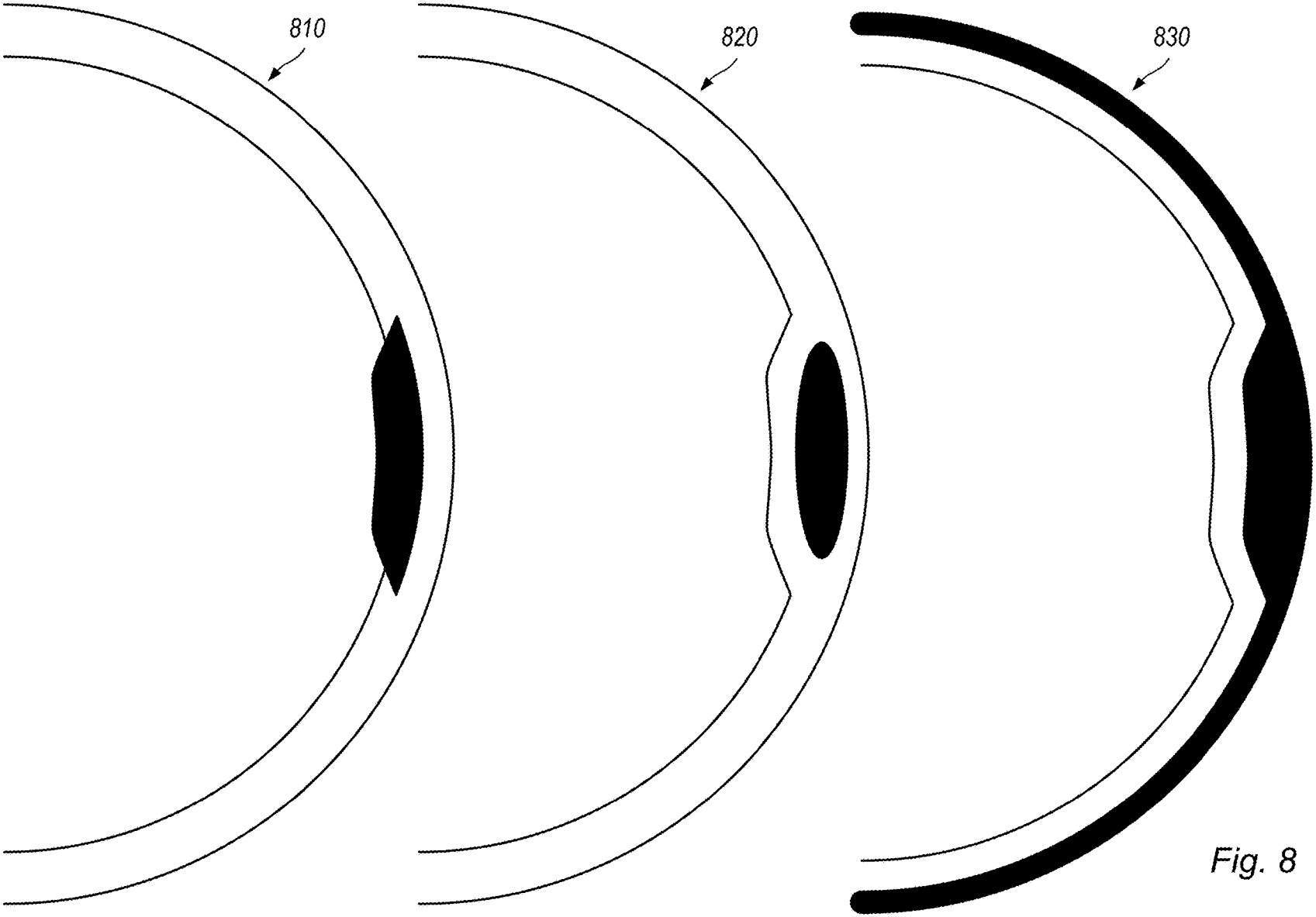
FIGS. 8 and 9 are diagrams illustrating example discs with different materials used in a grip sector, according to some embodiments.
Figure 9:
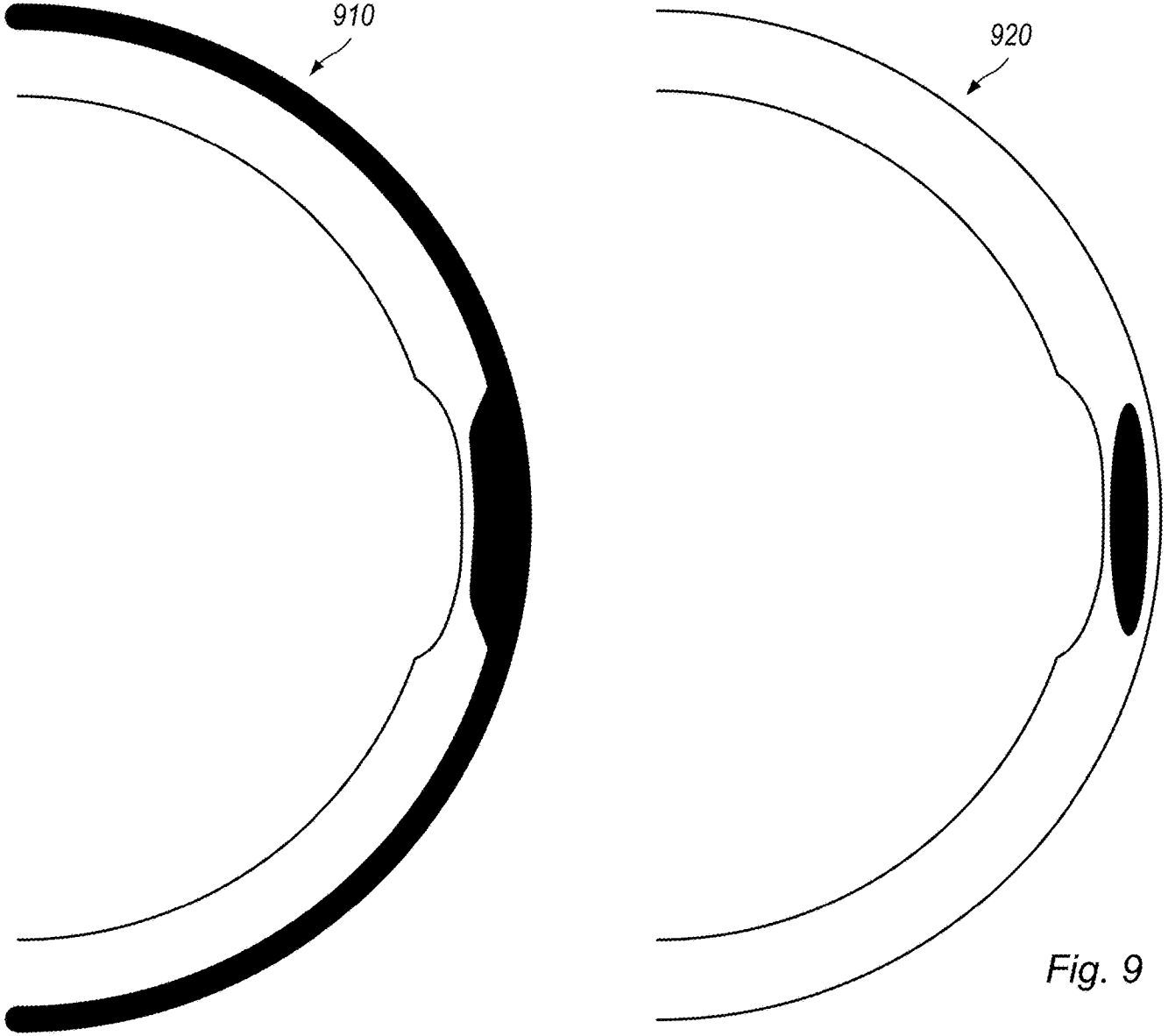

FIGS. 8 and 9 are diagrams illustrating example discs with different materials used in a grip sector, according to some embodiments. In the illustrated embodiment, discs 810, 820, and 830 have wider grip region(s) than non-grip regions while (these discs may correspond to relatively slower discs in a set of discs such as mid-ranges) while discs 910 and 920 have narrower grip region(s) than non-grip regions (these discs may correspond to relatively faster discs in a set of discs such as high-speed drivers). Note that the illustrated grip sectors are not drawn to scale.

All of the discs in FIGS. 8 and 9 include at least two different types of material having different densities, with one type of material shown solid and the other outlined. The differences in amounts of the different types of materials may facilitate even weight distribution in grip and non-grip regions, in some embodiments.

Discs 810, 820, and 830, in the illustrated example, have a portion shown in solid that is less dense than the outlined portion of the disc. For disc 810, the less dense portion is gripped by the user and also extends within the rim (in other embodiments, the less dense portion may only correspond to the difference in width between the grip region and non-grip regions, but this configuration may not be able to entirely balance the weights of the different regions while the illustrated example may).

For disc 820, the less dense material is embedded within the grip region and is not gripped by the user. In this embodiment, the less dense material may or may not be visible on the outside of the disc.

For disc 830, the less dense material is included around the entire rim (e.g., in a bonded fashion similar to discs such as various MVP Disc Sports discs or the Innova Nova disc). As shown, the outer material has a greater width in the grip region in this example. Note that a lighter outer rim may reduce the gyroscopic effect of disc spin but may also be easier for newer players to throw because it may spin faster when thrown with a given amount of power.

Discs 910 and 920, in the illustrated example, have a portion shown in solid that is denser than the outlined portion of the disc. For disc 910, the denser portion is wider in the grip region, similar to the discussion above with reference to disc 830. The denser outer rim may also increase gyroscopic effects of disc spin.

For disc 920, the denser material is embedded within the grip region. In other embodiments (not shown) the denser material may be gripped by the user and may or may not be visible on the outside of the disc.

The disclosed shapes of inserts of material are included for purposes of illustration, but are not intended to limit the scope of the present disclosure; various other insert or injected shapes are contemplated. In other embodiments, entire sectors of the disc corresponding to grip or non-grip regions may be formed of different materials to reduce weight differences. Further, various disclosed techniques may be combined. As one example, different wing shapes for grip and non-grip regions may be combined with different distributions of materials with different densities.

Additional Examples

Figure 10:
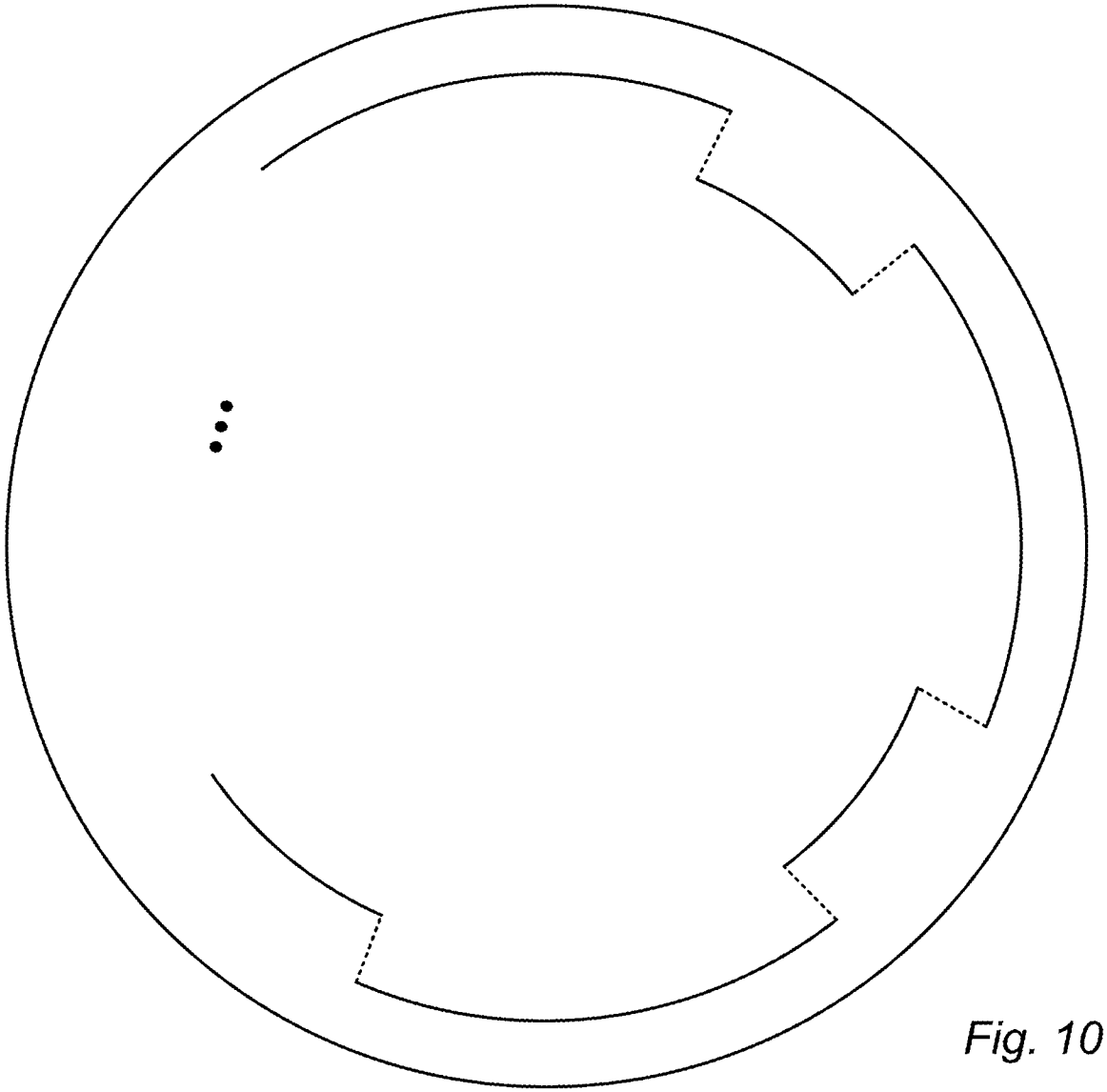
FIG. 10 is a diagram showing a disc with three or more grip regions, according to some embodiments.

FIG. 10 is a diagram showing a disc with three or more grip regions, according to some embodiments. In the illustrated embodiment, the disc includes at least three regions having a relatively smaller width and at least three regions having a greater width. In various embodiments, discs may include any appropriate number of grip regions (although this may be limited by the number of regions that can fit within a disc for a given hand size and grip style) and the number of grip regions may be odd or even. As discussed above, the transitions between regions may be continuous or may have one of various appropriate shapes.

In some embodiments, one or more additional components may be included in a disc and configured, in conjunction with the grip regions, to evenly distribute weight. For example, a disc may include one or more electronic components which may be more or less dense than the disc material. In these embodiments, the electronics and the grip zones may be synergistically balanced to evenly distribute weight. Thus, a denser electronic component may be placed in a sector of the disc with a narrower rim width or vice versa. Examples of electronic components include sensors such as accelerometers or pressure sensors configured to measure the acceleration (linear, angular, or both), velocity (linear, angular, or both), nose angle, flight time, etc. of a thrown disc. The electronics may communicate this data via an embedded screen, via wireless communications, via a communications cable plugged into a charging port, etc. As another example, an audio output or light emitting device or a wireless communication module may facilitate finding lost discs. These output devices may be triggered based on various criteria, e.g., if a disc does not move for a threshold amount of time after being thrown or based on wireless communications with a device such as a cell phone running an application that the user uses to communicate with electronics in the disc. As another example, an output device may activate if a disc is determined to be in the water (e.g., based on an electrical connection being formed by the water between two electrodes exposed on the outside of a disc). As another example, an output device may activate each time a disc is thrown, e.g., being energized by the throw of the disc. For example, energy from the spin of a thrown disc may wind a spring, and unwinding of the spring when the disc is at rest may be used to output an audible signal until the energy has dissipated. Various disclosed techniques for providing rotational symmetry and even weight distribution may be used independently of the grip zone concepts discussed herein, e.g., to compensate for the weight of electronics or other components.

Note that electrodes may be plastic conductors, in some embodiments, e.g., to comply with regulations that state that metal may not be exposed on the outside of a disc. In other embodiments, the electrodes may be metal. In some embodiments, a battery for any electronic components may be charged wirelessly or the disc may include an external charging port. In some embodiments the battery may be charged by mechanical energy imparted to the disc, e.g., vibration, rotation, etc.

In some embodiments, disclosed discs may meet all of the conditions set forth by the PDGA technical standards for discs used in play (e.g., in the Jan. 20, 2021 revision of the Manufacturer Guidelines for Obtaining PDGA Approval of Golf Discs and Targets). Other embodiments of disclosed discs may not meet one or more of these standards at the time of filing this application (although the standards may change over time).

In some embodiments, a disc includes three or more different rim widths, e.g., to provide grip regions with different widths. As one example, a disc may include four grip regions, two of which have a first width and two of which have a second, different width. This may allow a disc (or set of discs with matching grip regions) to be used by players with different preferences or hand sizes, for example. In some embodiments, a given manufacturer may offer multiple disc lines with different nominal grip widths for users with different preferences.

Figure 11:
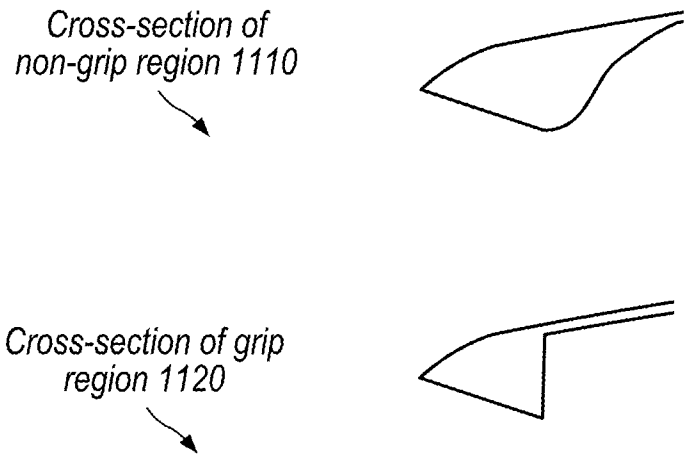
FIG. 11 is another diagram illustrating an example disc with different wing shapes in grip and non-grip regions, according to some embodiments.

FIG. 11 is another diagram illustrating an example disc with different wing shapes in grip and non-grip regions, according to some embodiments. In the illustrated example, non-grip region/sector 1110 has a different cross-sectional rim shape than grip region/sector 1120. In the illustrated example, the non-grip region has a curved surface that is not substantially perpendicular to the flight plate. This may increase aerodynamics and may be acceptable from a gripping perspective, given that players will grip the disc in the grip region and need not hold the disc using the non-grip region. Generally, a rim may include a substantially perpendicular portion to the flight plate for gripping and a non-grip portion with another shape, e.g., that gradually transitions to the flight-plate.

In some embodiments similar to FIG. 11, the grip sector may weigh substantially less than the non-grip sector. This may be at least partially remedied by different materials, etc. as discussed above, but also may be somewhat acceptable, e.g., in designs with fairly high rotational symmetry (e.g., at least two grip sectors). Further, the different rim shapes may be used to evenly distribute weight in some situations (e.g., adding more material to the non-grip region of a mid-range may increase its similarity to a grip region).

Figure 12:
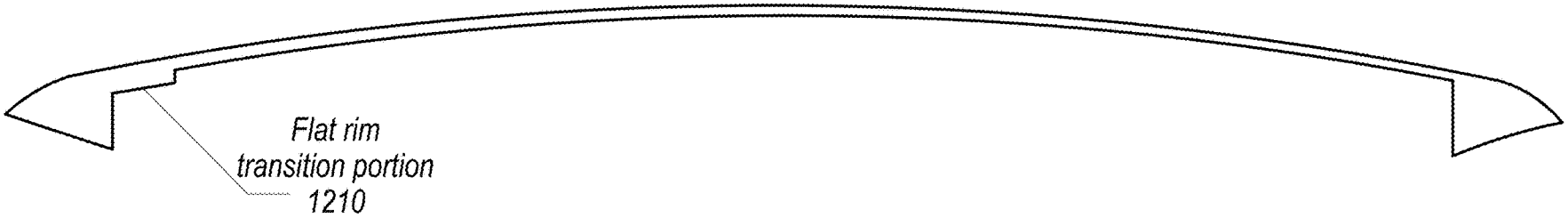
FIG. 12 is a diagram illustrating an example disc with a flat transition portion, according to some embodiments.

FIG. 12 is a diagram illustrating an example disc with a flat transition portion 1210 in a grip region of the rim. In some embodiments, a set of discs may therefore have the same nominal effective rim height even though the rim height would have been different without use of disclosed techniques. Said another way, although different discs may have different distances between the top of the flight plate and the bottom of the rim, the effective rim height between the flat transition portion and the bottom of the rim may be nominally the same. Further, including a flat transition portion for all or a subset of the grip regions may facilitate different types of shots (e.g., a forehand thrower may prefer a lesser rim height but may otherwise desire a similar flight). Still further, a flat transition portion may provide a circular flight plate, which may comply with one or more regulations from a governing body such as the PDGA.

In some embodiments, a disc may have grip regions with multiple different widths, effective rim heights, or both. For example, for a disc with four grip regions, two of the regions may be relatively wider and two relatively narrower. The pairs of regions with the same width may be positioned opposite each other to improve balance. Similarly, for discs such as that shown in FIG. 12, grip regions may have a flat transition portion with one thickness (and one effective rim height) for one grip region and a flat transition portion with another thickness (or the normal flight plate thickness) for another grip region.

Disclosed techniques with multiple styles of grip regions may allow a given disc to fit into multiple sets of discs that have at least one of the same grip region width/depth. Further, this may allow a given disc to be comfortable for users with different hand sizes. In some embodiments, the disc includes markings (e.g., a stamp) on the top, bottom, or both of the disc to indicate which grip regions are which width. In some embodiments, similar information may be incorporated into the disc itself, e.g., by including raised or recessed markings in the mold.

Disclosed discs may be manufactured using any of various techniques. For example, molds corresponding to the disclosed disc shapes may be used with injection molding techniques to create disclosed discs. In other embodiments, disclosed discs may be 3D printed using various materials. In various embodiments, a computer-readable medium may store information specifying designs of disclosed discs. This information (e.g., a CAD file such as DWG or MODEL files, 3D printer files such as STL files or OBJ file, etc.) may program a manufacturing system to print discs according to the design or to construct molds used to construct discs according to the design. In some embodiments, a method includes manufacturing a discs or set of discs having disclosed properties.

For discs with concave portions (e.g., the disc of FIG. 6C) the disc may manufactured using injection modeling by rotating the disc 90 degrees before lifting the mold (or lifting the disc from the mold), to avoid the mold catching on the wider rim sectors.

Disclosed discs may exhibit various orders of rotational symmetry, including 1, 2, 3, 4, 5, or 6 for example.

Example Additional Embodiments

1. A flying disc, comprising:
   a central flight plate having top and bottom surfaces;
   an outer annular rim surrounding the flight plate and defined by an outer perimeter of the disc and a wall extending from the bottom surface of the flight plate to create a cavity beneath the bottom surface of the flight plate;
   wherein the outer rim includes:
   three or more grip sectors having a first average rim width; and
   three or more non-grip sectors having a second, different average rim width.
2. The flying disc of embodiment 1, wherein the one or more of the grip sectors have a different rim shape than one or more of the non-grip sectors.

3. The flying disc of embodiment 2, wherein the wall of one or more grip sectors is substantially perpendicular to the central flight plate and the wall of one or more non-grip sectors is angled at least 20 degrees from parallel with the central flight plate.
4. The flying disc of embodiment 1, wherein the second average rim width is at least 1.2 times greater than the first average rim width.
5. The flying disc of embodiment 1, wherein the first average rim width is at least 1.2 times greater than the second average rim width.
6. The flying disc of embodiment 1, wherein a weight of the given grip sector is within 5 percent of the weight of a given non-grip sector.
7. The flying disc of embodiment 6, wherein one at least one grip sector includes an electronic device and at least one non-grip sector does not include an electronic device.
8. The flying disc of embodiment 6, wherein one at least one non-grip sector includes an electronic device and at least one grip sector does not include an electronic device.
9. The flying disc of embodiment 1, wherein a portion of the rim between first and second radial distances from a center of the flight plate is has a different average rim depth for the first sector than for the second sector.
10. The flying disc of embodiment 1, wherein the flying disc has at least order 3 rotational symmetry.
11. The flying disc of embodiment 1, wherein the grip sectors have different central angles than the non-grip sectors.
12. The flying disc of embodiment 1, wherein the grip sectors include a material having a density that is different than any materials of the non-grip sectors.
13. The flying disc of embodiment 1, wherein the grip sectors and non-grip sectors have different average densities of material.
14. A flying disc, comprising:

a central flight plate having top and bottom surfaces;

an outer annular rim surrounding the flight plate and defined by an outer perimeter of the disc and a wall extending from the bottom surface of the flight plate to create a cavity beneath the bottom surface of the flight plate;

wherein the outer rim includes:

a first sector having a first width property under which the radial width of the rim is between a first radial width and 1.2 times the first radial width, inclusive; and a second sector having a second width property under which the radial width of the rim has at least a second radial width;

wherein the second radial width is at least 1.2 times the first radial width.

1.1. A set of discs, comprising:

a first flying disc having a first sector with a first nominal average rim width and a second sector with a second, greater average rim width; and a second flying disc having a third sector with the first nominal average rim width and a fourth sector with a third, smaller average rim width.

1.2. The set of discs of embodiment 1.1, further comprising a third flying discs having a sector with the first nominal average rim width and another sector with an average rim width that is greater than the second rim width.

1.3. The set of discs of embodiment 1.2, further comprising a fourth flying disc having a sector with the first nominal average rim width and another sector with a rim width that is smaller than the third rim width.

1.4. The set of discs of embodiment 1.1, wherein at least one of the discs has a mid-range beveled rim and at least one of the discs has a long-range driver rim.

1.5. The set of discs of embodiment 1.1, further comprising a third flying disc having a nominal rim width for its entire rim that corresponds to the first nominal average rim width.

1.6. The set of discs of embodiment 1.1, wherein the first sector has a different average density than the third sector.

1.7. The set of discs of embodiment 1.1, wherein the second sector has a different average density than the fourth sector.

1.8. The set of discs of embodiment 1.1, wherein each disc in the set of discs has at least three grip sectors having the first nominal average rim width and at least three non-grip sectors.

1.9. The set of discs of embodiment 1.1, wherein at least one of the discs includes a material having a density that is different than any of the materials included in at least one other disc in the set of discs.

1.10. The set of discs of embodiment 1.1, wherein the first flying disc includes a thicker flight plate portion such that the first flying disc and the second flying disc have the same nominal rim wall height in the first sector and the third sector, wherein the height of a cavity under the center of a flight plate of the first disc is greater than a height of a cavity under the center of a flight plate of the second disc.

A method for manufacturing a flying disc or set of flying discs of any of the previous embodiments using a mold having a corresponding shape.

A non-transitory computer readable storage medium having stored thereon design information that specifies a design of a disc or set of discs of any of the previous claims, wherein the design information is a format recognized by a 3D printing system that is programmable by the design information to produce the disc or set of discs according to the design.

The present disclosure includes references to "an "embodiment" or groups of "embodiments" (e.g., "some embodiments" or "various embodiments"). Embodiments are different implementations or instances of the disclosed concepts. References to "an embodiment," "one embodiment," "a particular embodiment," and the like do not necessarily refer to the same embodiment. A large number of possible embodiments are contemplated, including those specifically disclosed, as well as modifications or alternatives that fall within the spirit or scope of the disclosure.

This disclosure may discuss potential advantages that may arise from the disclosed embodiments. Not all implementations of these embodiments will necessarily manifest any or all of the potential advantages. Whether an advantage is realized for a particular implementation depends on many factors, some of which are outside the scope of this disclosure. In fact, there are a number of reasons why an implementation that falls within the scope of the claims might not exhibit some or all of any disclosed advantages. For example, a particular implementation might include other equipment outside the scope of the disclosure that, in conjunction with one of the disclosed embodiments, negates or diminishes one or more the disclosed advantages. Furthermore, suboptimal design execution of a particular implementation (e.g., implementation techniques or tools) could also negate or diminish disclosed advantages. Even assuming a skilled implementation, realization of advantages may still depend upon other factors such as the environmental circumstances in which the implementation is deployed. For example, inputs supplied to a particular implementation may prevent one or more problems addressed in this disclosure from arising on a particular occasion, with the result that the benefit of its solution may not be realized. Given the existence of possible factors external to this disclosure, it is expressly intended that any potential advantages described herein are not to be construed as claim limitations that must be met to demonstrate infringement. Rather, identification of such potential advantages is intended to illustrate the type(s) of improvement available to designers having the benefit of this disclosure. That such advantages are described permissively (e.g., stating that a particular advantage "may arise") is not intended to convey doubt about whether such advantages can in fact be realized, but rather to recognize the technical reality that realization of such advantages often depends on additional factors.

Unless stated otherwise, embodiments are non-limiting. That is, the disclosed embodiments are not intended to limit the scope of claims that are drafted based on this disclosure, even where only a single example is described with respect to a particular feature. The disclosed embodiments are intended to be illustrative rather than restrictive, absent any statements in the disclosure to the contrary. The application is thus intended to permit claims covering disclosed embodiments, as well as such alternatives, modifications, and equivalents that would be apparent to a person skilled in the art having the benefit of this disclosure.

For example, features in this application may be combined in any suitable manner. Accordingly, new claims may be formulated during prosecution of this application (or an application claiming priority thereto) to any such combination of features. In particular, with reference to the appended claims, features from dependent claims may be combined with those of other dependent claims where appropriate, including claims that depend from other independent claims. Similarly, features from respective independent claims may be combined where appropriate.

Accordingly, while the appended dependent claims may be drafted such that each depends on a single other claim, additional dependencies are also contemplated. Any combinations of features in the dependent that are consistent with this disclosure are contemplated and may be claimed in this or another application. In short, combinations are not limited to those specifically enumerated in the appended claims.

Where appropriate, it is also contemplated that claims drafted in one format or statutory type (e.g., apparatus) are intended to support corresponding claims of another format or statutory type (e.g., method).

Because this disclosure is a legal document, various terms and phrases may be subject to administrative and judicial interpretation. Public notice is hereby given that the following paragraphs, as well as definitions provided throughout the disclosure, are to be used in determining how to interpret claims that are drafted based on this disclosure.

References to a singular form of an item (i.e., a noun or noun phrase preceded by "a," "an," or "the") are, unless context clearly dictates otherwise, intended to mean "one or more." Reference to "an item" in a claim thus does not, without accompanying context, preclude additional instances of the item. A "plurality" of items refers to a set of two or more of the items.

The word "may" is used herein in a permissive sense (i.e., having the potential to, being able to) and not in a mandatory sense (i.e., must).

The terms "comprising" and "including," and forms thereof, are open-ended and mean "including, but not limited to."

When the term "or" is used in this disclosure with respect to a list of options, it will generally be understood to be used in the inclusive sense unless the context provides otherwise. Thus, a recitation of "x or y" is equivalent to "x or y, or both," and thus covers 1) x but not y, 2) y but not x, and 3) both x and y. On the other hand, a phrase such as "either x or y, but not both" makes clear that "or" is being used in the exclusive sense.

A recitation of "w, x, y, or z, or any combination thereof" or "at least one of . . . w, x, y, and z" is intended to cover all possibilities involving a single element up to the total number of elements in the set. For example, given the set [w, x, y, z], these phrasings cover any single element of the set (e.g., w but not x, y, or z), any two elements (e.g., w and x, but not y or z), any three elements (e.g., w, x, and y, but not z), and all four elements. The phrase "at least one of . . . w, x, y, and z" thus refers to at least one element of the set [w, x, y, z], thereby covering all possible combinations in this list of elements. This phrase is not to be interpreted to require that there is at least one instance of w, at least one instance of x, at least one instance of y, and at least one instance of z.

Various "labels" may precede nouns or noun phrases in this disclosure. Unless context provides otherwise, different labels used for a feature (e.g., "first rim portion," "second rim portion," "particular rim portion," "given rim portion," etc.) refer to different instances of the feature. Additionally, the labels "first," "second," and "third" when applied to a feature do not imply any type of ordering (e.g., spatial, temporal, logical, etc.), unless stated otherwise.

The phrase "based on" or is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

The phrases "in response to" and "responsive to" describe one or more factors that trigger an effect. This phrase does not foreclose the possibility that additional factors may affect or otherwise trigger the effect, either jointly with the specified factors or independent from the specified factors. That is, an effect may be solely in response to those factors, or may be in response to the specified factors as well as other, unspecified factors. Consider the phrase "perform A in response to B." This phrase specifies that B is a factor that triggers the performance of A, or that triggers a particular result for A. This phrase does not foreclose that performing A may also be in response to some other factor, such as C. This phrase also does not foreclose that performing A may be jointly in response to B and C. This phrase is also intended to cover an embodiment in which A is performed solely in response to B. As used herein, the phrase "responsive to" is synonymous with the phrase "responsive at least in part to." Similarly, the phrase "in response to" is synonymous with the phrase "at least in part in response to."

What is claimed is:

1. A first flying disc, comprising:

a central flight plate having top and bottom surfaces; and an outer rim surrounding the flight plate and defined by a circular outer perimeter of the disc and an inner rim surface connected to the bottom surface of the flight plate, wherein;

the outer rim defines a cavity beneath the bottom surface of the flight plate;

the flight plate and the outer rim form a continuous top surface of the first flying disc from a center of the flight plate to the outer perimeter; and the outer rim includes:

two or more grip sectors that include an inner rim grip wall at least 8 millimeters tall that is perpendicular to a plane defined by a perimeter of the central flight plate, wherein the inner rim grip wall is concave and curves in the same direction as a corresponding sector of the circular outer perimeter; and two or more non-grip sectors that include an inner rim non-grip surface that is positioned within the cavity and angles or curves down and away from the flight plate, within 4 millimeters of the flight plate as measured in a direction perpendicular to the plane.

2. The first flying disc of claim 1, wherein:

the grip sectors have a first average distance between the grip wall and the outer perimeter; and the non-grip sectors have a second average distance between a rim edge connected to the flight plate and the outer perimeter.

3. The first flying disc of claim 2, wherein the grip sectors include respective flat portions between the grip wall and the central flight plate, wherein a given flat portion is parallel to the flight plate.

4. The first flying disc of claim 3, wherein the flat portions and the two or more non-grip sectors define a circular boundary of the central flight plate.

5. The first flying disc of claim 1, wherein a portion of the outer rim between first and second radial distances from a center of the flight plate has a different average rim depth for the grip sectors than for the non-grip sectors.

6. The first flying disc of claim 1, wherein the outer rim includes three or more grip sectors and three or more non-grip sectors.

7. The first flying disc of claim 1, wherein the two or more grip sectors make up at least one third of the circumference of the outer rim.

8. The first flying disc of claim 1, wherein a tallest part of the grip sectors is located at a different radial distance from a center of the flight plate than a tallest part of the non-grip sectors.

9. The first flying disc of claim 1, wherein two or more of the grip sectors have different shapes.

10. The first flying disc of claim 1, wherein a given grip sector has a different radial width than a given non-grip sector.

11. The first flying disc of claim 1, and:

a second flying disc, comprising:

a second central flight plate having top and bottom surfaces; and a second outer rim surrounding the second flight plate and defined by an outer perimeter of the second flying disc and an inner rim surface connected to the bottom surface of the second flight plate, wherein the second rim defines a cavity beneath the bottom surface of the second flight plate;

wherein the second outer rim includes:

two or more second grip sectors having a same grip shape as the two or more grip sectors of the first flying disc; and two or more non-grip sectors having a different shape than the two or more non-grip sectors of the first flying disc.

12. The first flying disc of claim 11, wherein:

the two or more non-grip sectors of the second flying disc having a different width than the two or more non-grip sectors of the first flying disc; and the two or more second grip sectors of the second flying disc and the two or more grip sectors of the first flying disc include respective flat rim portions between the grip wall and the central flight plate and the flat rim portions of the second flying disc have a different radial width than the flat rim portions of the first flying disc.

13. The first flying disc of claim 11, wherein the outer rim includes a first transition section between a grip sector and a first adjacent non-grip sector and a second transition section between the grip sector and a second adjacent non-grip sector; and the first and second transition sections have different shapes when viewed from below the first flying disc.

14. A set of discs, comprising:

a first disc, comprising:

a first central flight plate having top and bottom surfaces;

an first outer rim surrounding the first flight plate and defined by an outer perimeter of the disc and an inner rim surface connected to the bottom surface of the first flight plate, wherein the first outer rim defines a cavity beneath the bottom surface of the first flight plate;

wherein the first outer rim includes:

two or more first grip sectors having a first rim width and a first rim shape; and two or more first non-grip sectors having a second rim width and a second rim shape; and a second disc, comprising:

a second central flight plate having top and bottom surfaces;

an second outer rim surrounding the second flight plate and defined by an outer perimeter of the disc and an inner rim surface connected to the bottom surface of the second flight plate, wherein the second outer rim defines a cavity beneath the bottom surface of the second flight plate;

wherein the second outer rim includes:

two or more second grip sectors having the first rim width and the first rim shape; and two or more second non-grip sectors having a third rim width and a third rim shape.

15. The set of discs of claim 14, wherein the first disc is a distance driver and the second disc is a fairway driver.

16. The set of discs of claim 14, wherein the second rim width is greater than the first rim width and third rim width is smaller than the first rim width.

17. The set of discs of claim 14, wherein:

the first and second central flight plates are circular;

the first and second grip sectors respectively include:

an inner rim grip wall; and a flat transition portion between the inner rim grip wall and the flight plate; and the flat transition portion of the two or more second grip sectors has a different width than the flat transition portion of the two or more first grip sectors, such that the first and second central flight plates have different diameters.

18. A flying disc, comprising:

a central flight plate having top and bottom surfaces; and an outer rim surrounding the flight plate and defined by a circular outer perimeter of the disc and an inner rim surface connected to the bottom surface of the flight plate, wherein:

the outer rim defines a cavity beneath the bottom surface of the flight plate;

the flight plate and the outer rim form a continuous top surface of the flying disc from a center of the flight plate to the outer perimeter;

no portion of the disc extends outside of the circular outer perimeter; and the outer rim includes:

two or more grip sectors that include an inner rim grip wall that is perpendicular to a plane defined by a perimeter of the central flight plate, wherein the inner rim grip wall is concave and curves in the same direction as a corresponding sector of the circular outer perimeter; and two or more non-grip sectors that include an inner rim non-grip surface that is positioned within the cavity and is shaped differently than the inner rim grip wall of the grip sectors, wherein the inner rim non-grip surface angles or curves down and away from a meeting of the non-grip surface to the flight plate.

19. The flying disc of claim 18, wherein:

the two or more grip sectors include an inner rim grip wall at least 9 millimeters tall that is perpendicular to the plane; and the two or more non-grip sectors include an inner rim non-grip surface that angles or curves away from the flight plate, within 3 millimeters of the flight plate as measured in a direction perpendicular to the plane.

20. The flying disc of claim 18, wherein:

the grip sectors have a first average distance between the grip wall and the outer perimeter; and the non-grip sectors have a second average distance between a rim edge connected to the flight plate and the outer perimeter.

* * * * *